US007442001B2

(12) United States Patent
Higashikawa et al.

(10) Patent No.: US 7,442,001 B2
(45) Date of Patent: Oct. 28, 2008

(54) BOOM ASSEMBLY

(75) Inventors: Yoshitaka Higashikawa, Sakai (JP); Naoki Onishi, Kawachinagano (JP); Ryoichi Nishi, Kawachinagano (JP); Hiroki Fukudome, Sakai (JP)

(73) Assignee: Kubota Corporation, Osaka (JP)

( * ) Notice: Subject to any disclaimer, the term of this patent is extended or adjusted under 35 U.S.C. 154(b) by 43 days.

(21) Appl. No.: 11/225,850

(22) Filed: Sep. 13, 2005

(65) Prior Publication Data

US 2006/0182597 A1 Aug. 17, 2006

(30) Foreign Application Priority Data

Jan. 5, 2005 (JP) ..... 2005-000754

(51) Int. Cl.
*E02F 9/00* (2006.01)

(52) U.S. Cl. ..... 414/722; 52/111; 29/891

(58) Field of Classification Search ..... 414/722, 414/686; 52/111, 115, 732.1; 212/347, 348; 29/891, 891.1

See application file for complete search history.

(56) References Cited

U.S. PATENT DOCUMENTS 4,439,089 A 3/1984 Anderson et al.
5,152,659 A * 10/1992 Waka ..... 414/722
6,572,323 B2 * 6/2003 Schupback ..... 414/722
2005/0111953 A1 * 5/2005 Westendorf et al. ..... 414/686

FOREIGN PATENT DOCUMENTS

JP 6-53648 7/1994
JP 11-158907 6/1999

* cited by examiner

*Primary Examiner*—Donald Underwood
(74) *Attorney, Agent, or Firm*—The Webb Law Firm

(57) ABSTRACT

A boom assembly is bent at a longitudinal center portion thereof to present an upwardly convex shape. The assembly includes a front boom body and a rear boom body. The front boom body and the rear main body each includes a main body consisting essentially of a pair of right and left lateral plates and a top plate interconnecting upper edges of the respective lateral plates. The main body is formed with an upper face and a lower edge thereof being bent in a longitudinal direction thereof into an arc face having a predetermined radius of curvature. The front or rear main body further includes a bottom plate disposed downwardly of the top plate and between the right and left lateral plates. Each main body is formed by bending a plate member into a reverse U-shaped cross section and each bottom plate is comprised of a plate member provided separately from the plate member forming the main body.

8 Claims, 8 Drawing Sheets

BOOM ASSEMBLY

BACKGROUND OF THE INVENTION

1. Field of the Invention

The present invention relates to a boom assembly employed in a loading/unloading vehicle for an agricultural, civil engineering work, etc., such as a tractor-mounted loader comprised of a tractor equipped with a front loader and/or a backhoe, a self-propelled loader (wheeled loader, a self-propelled backhoe, a power shovel, etc.).

2. Description of the Related Art

Conventionally, as a boom assembly used in a tractor-mounted loader, there is known a boom assembly which is bent at a longitudinal center portion thereof to present an upwardly convex arc shape and which includes a front boom body provided on the front side from the longitudinal center portion and a rear boom body provided on the rear side from the longitudinal center portion (see e.g. Japanese Patent Application "Kokai" No. 11-158907, in particular its FIGS. 9 and 11).

The front and rear boom bodies of this boom assembly are formed by bending a plate member into a cylindrical shape, or by placing a pair of right and left members, each formed by bending a plate member into an angular hooked cross sectional shape, into abutment with each other and then fixing these together by welding.

Further, with this conventional boom assembly, each of the front and rear boom bodies has upper and lower faces which are formed straight, and as these front and rear boom bodies are connected to each other via a connecting member at the longitudinal center portion of the boom assembly, there is formed the boom assembly which is bent at the longitudinal center portion into the upwardly convex arc shape.

As another boom assembly to be used in a tractor-mounted loader, there is known a boom assembly taking an advantage of a curved appearance (see Japanese Utility Model Application "Kokai" No. 6-53648, in particular its FIG. 3).

This boom assembly includes right and left lateral plates, a top plate and a bottom plate which plates are comprised of separate members. The right and left lateral plates are formed in a curved appearance and the top plate and the bottom plate are bent in correspondence with the shapes of the edges of the right and left lateral plates. Then, these top and bottom plates are disposed between the right and left lateral plates, and right and left lateral edges of the top and bottom plate are fixedly welded to the inner faces of the lateral plates.

For a tractor-mounted loader for use in a tractor having a curved appearance in e.g. the top face of the hood, there is a desire to provide the boom assembly with a curved shape suitable for aesthetic matching with the curved shape of the hood.

In the case of the boom assembly disclosed in Japanese Utility Model Application "Kokai" No. 6-53648 described above, it is possible to provide such aesthetic matching between this boom assembly and the curved shape of the hood. However, weld beads are present on the top surface of the boom assembly. These beads not only deteriorate the aesthetic impression of the assembly, but also invite high manufacture cost due to the large amount of welding needed.

In order to solve the above problem, it may be conceivable to modify the boom assembly disclosed in the first cited document, i.e. Japanese Patent Application "Kokai" No. 11-158907 by bending the front and rear boom bodies thereof so as to provide the boom assembly with a shape aesthetically matched with the curved shape of the hood. However, such bending of the cylindrical boom bodies will be difficult.

SUMMARY OF THE INVENTION

In view of the above-described state of the art, a primary object of the present invention is to provide a boom assembly which is bent at a longitudinal center portion thereof to present an upwardly convex shape and whose front and rear sides are also bent to present an upwardly convex shape, the boom assembly having an improved appearance and being relatively easily formed.

For accomplishing the above-noted object, the present invention proposes a boom assembly which is bent at a longitudinal center portion thereof to present an upwardly convex shape, the assembly comprising:

a front boom body including:

a main body consisting essentially of a pair of right and left lateral plates and a top plate interconnecting upper edges of the respective lateral plates, the main body being formed with an upper face and a lower edge thereof being bent in a longitudinal direction thereof into an arc face having a predetermined radius of curvature, and a bottom plate disposed downwardly of the top plate and between the right and left lateral plates;

a rear boom body including:

a main body consisting essentially of a pair of right and left lateral plates and a top plate interconnecting upper edges of the respective lateral plates, the main body being formed with an upper face and a lower edge thereof being bent in a longitudinal direction thereof into an arc face having a predetermined radius of curvature, and a bottom plate disposed downwardly of the top plate and between the right and left lateral plates;

wherein each main body is formed by bending a plate member into a reverse U-shaped cross section; and each bottom plate is comprised of a plate member provided separately from said plate member forming the main body.

According to the above-described construction, it is possible to obtain a boom assembly with a shape aesthetically matched with e.g. a curved shape of the hood. In the course of this, as the main body (the top plate and the right and left lateral plates) of each boom body consisting of the right and left lateral plates and the top plate is formed by bending a plate member into a reverse U-shaped and upwardly convex configuration. Hence, no weld beads are present on the upper surface of the boom body, thus providing improved appearance. Moreover, the bottom plate is comprised of a plate member separate from the plate member forming the main body and this bottom plate is disposed downwardly of the top plate and between the right and left lateral plates. Therefore, this boom assembly can be formed with more ease than the conventional assembly including the cylindrical boom body bent to obtain the upwardly convex arc shape.

According to one preferred embodiment of the present invention, a distance between the bottom plate to a lower edge of each lateral plate progressively increases toward the longitudinal center portion of the boom assembly, to form a pipe accommodating space downwardly of the bottom plate and between the right and left lateral plates at said longitudinal center portion.

According to one preferred embodiment of the present invention, said front and rear boom bodies have an identical shape to each other.

According to one preferred embodiment of the present invention, said each boom body includes a cutaway portion which is formed by cutting away a predetermined longitudinal portion of the top plate from an end thereof adjacent the longitudinal center portion of the boom assembly, and by cutting away portions of the right and left lateral plates from the cutaway portion of the top plate along a vertical direction of the right and left lateral plates.

According to one preferred embodiment of the present invention, the radius of curvature of the upper face of the boom assembly at the longitudinal center portion is different from that at the front and rear longitudinal ends, and at the longitudinal center portion, there is provided a center connecting plate for interconnecting the top plates of the two boom bodies, the center connecting plate having an upwardly convex curved shape.

Further and other features and advantages thereof will become apparent upon reading the following detailed description of the invention with reference to the accompanying drawings.

DESCRIPTION OF THE PREFERRED EMBODIMENTS

Next, preferred embodiments of the invention will be described with reference to the accompanying drawings.

First Embodiment

Figure 1:
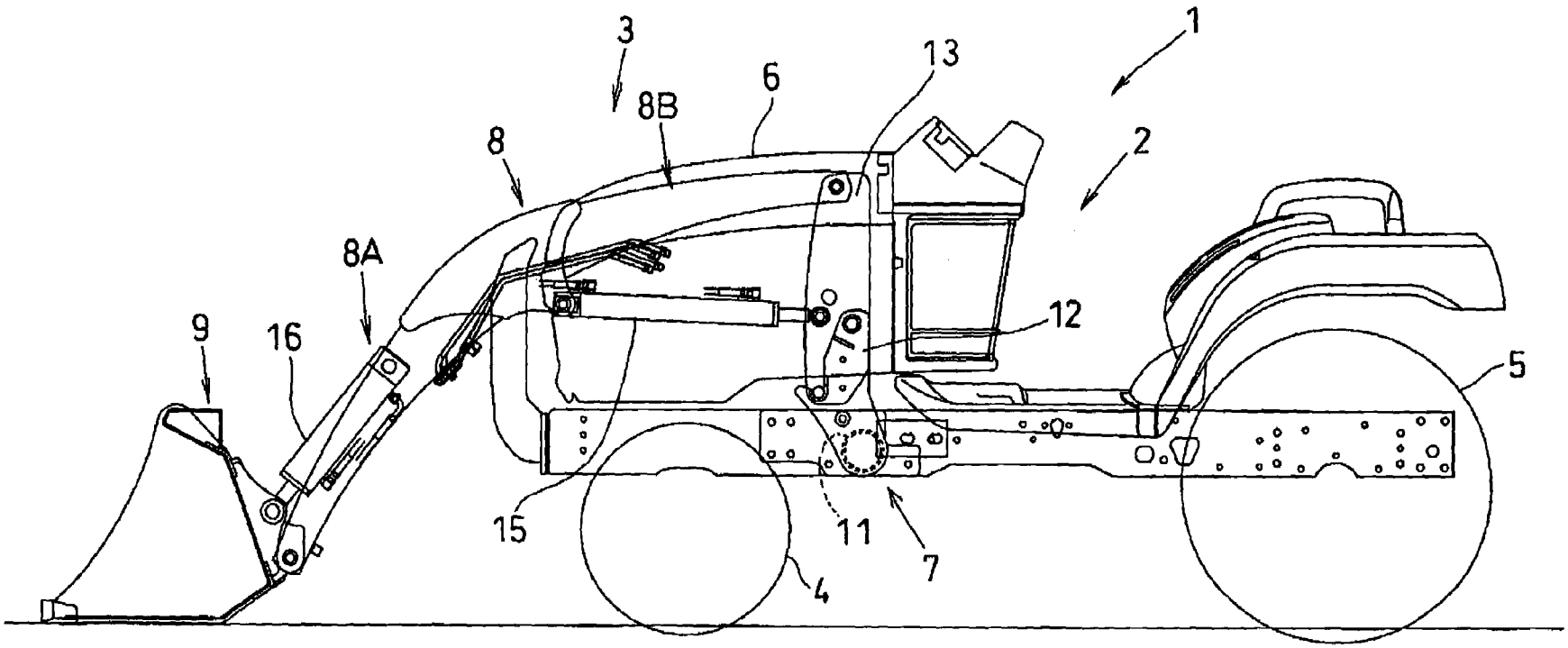
FIG. 1 is an overall side view showing a tractor-mounted loader having a boom assembly according to a first embodiment of the invention.
Figure 2:
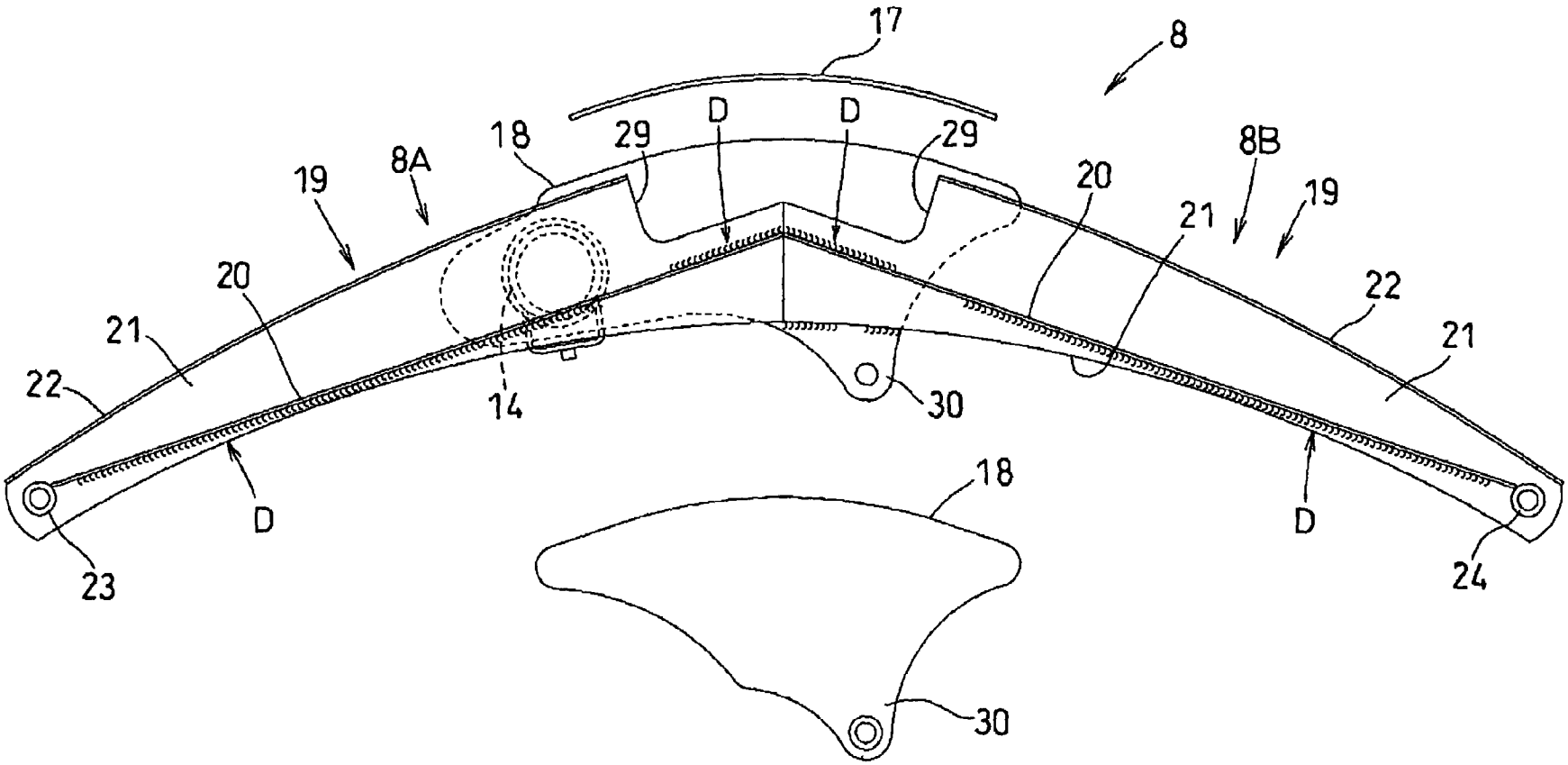
FIG. 2 is an exploded side view of the boom assembly.
Figure 3:
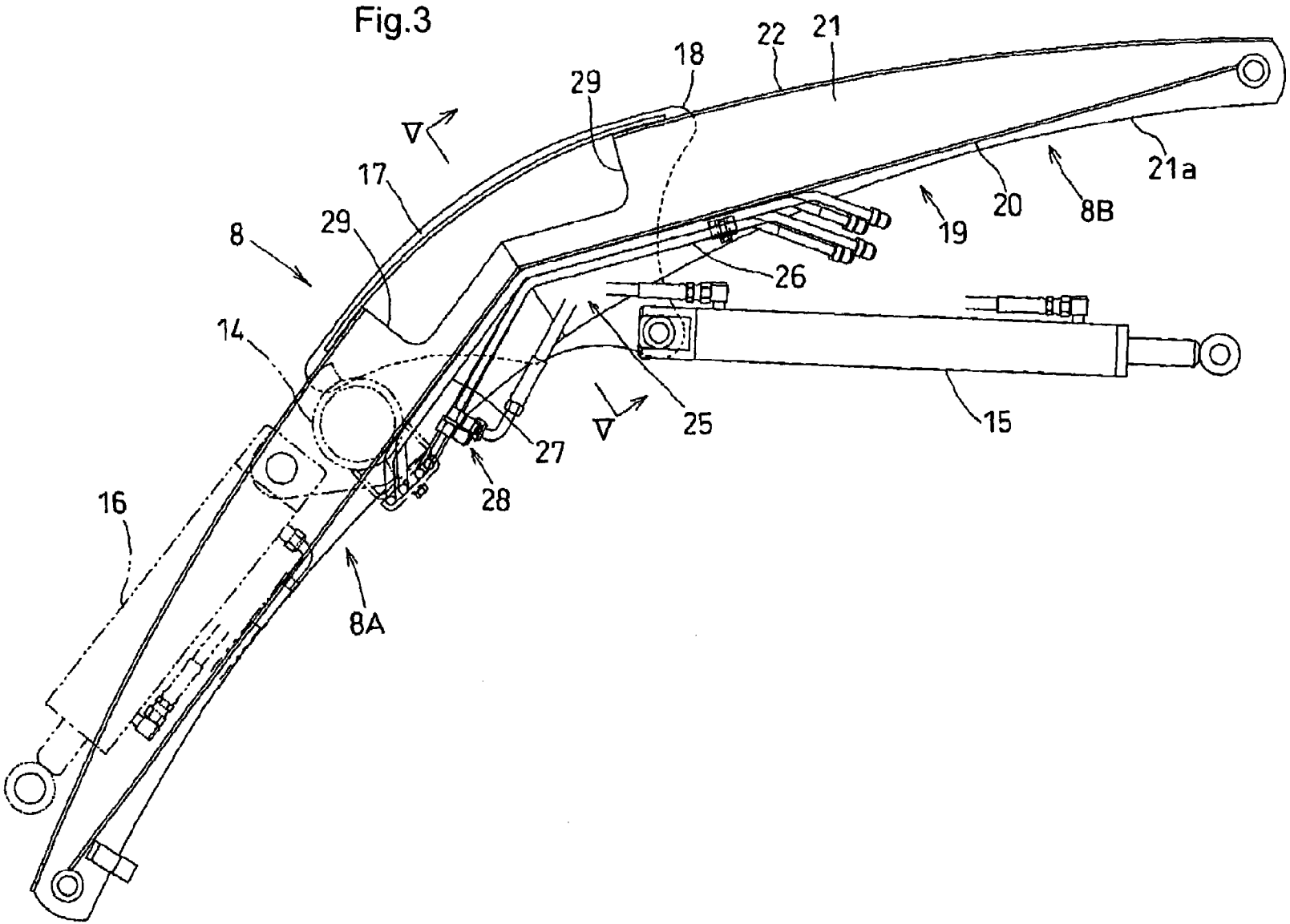
FIG. 3 is a side view in section showing principal portions of a front loader.

Referring to FIG. 1, a tractor-mounted loader 1, an example of a loading/unloading vehicle, includes a tractor 2 and a front loader 3 mounted to a front portion of the tractor 2.

The tractor 2 includes pairs of right and left front and rear wheels 4, 5 and a hood 6 is provided at the front portion thereof for covering en engine, a radiator, etc. The hood 6 has a curved shape at its upper surface, etc.

The front loader 3 consists mainly of a mounting frame 7, boom assemblies ("booms" hereinafter) 8, and a bucket 9.

The mounting frame 7 includes, as principal components thereof, a support table 11 provided under the front portion of the tractor 2 (downwardly of the rear end of the hood 6) and projecting outward from the tractor 2 along a right/left direction, a main frame 12 mounted on the support table 11 and projecting upward from the support table 11 and a pair of right and left side frames 13 detachably attached to the main frame 12.

Figure 4:
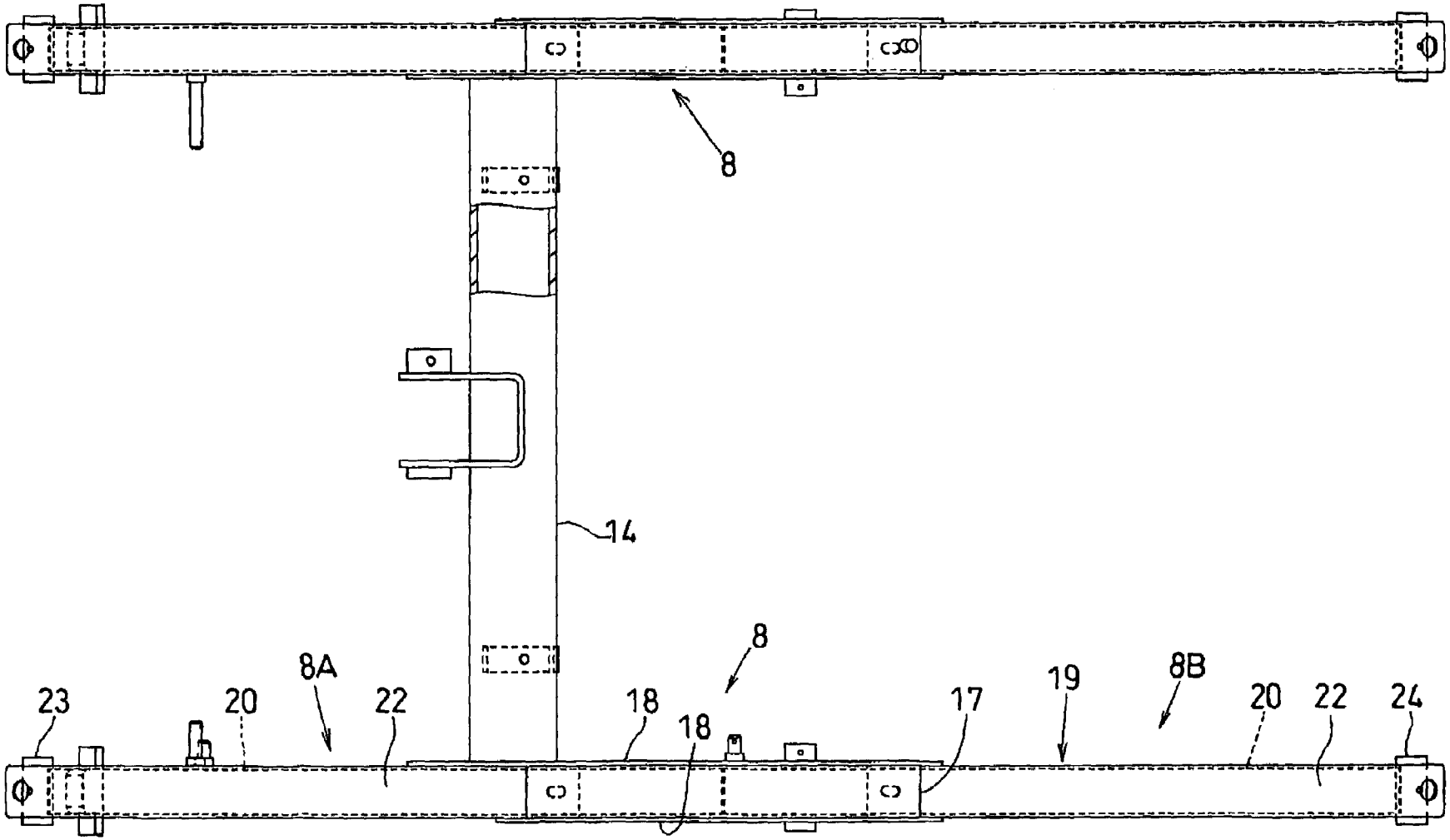
FIG. 4 is a plan view of the boom assembly.
Figure 5:
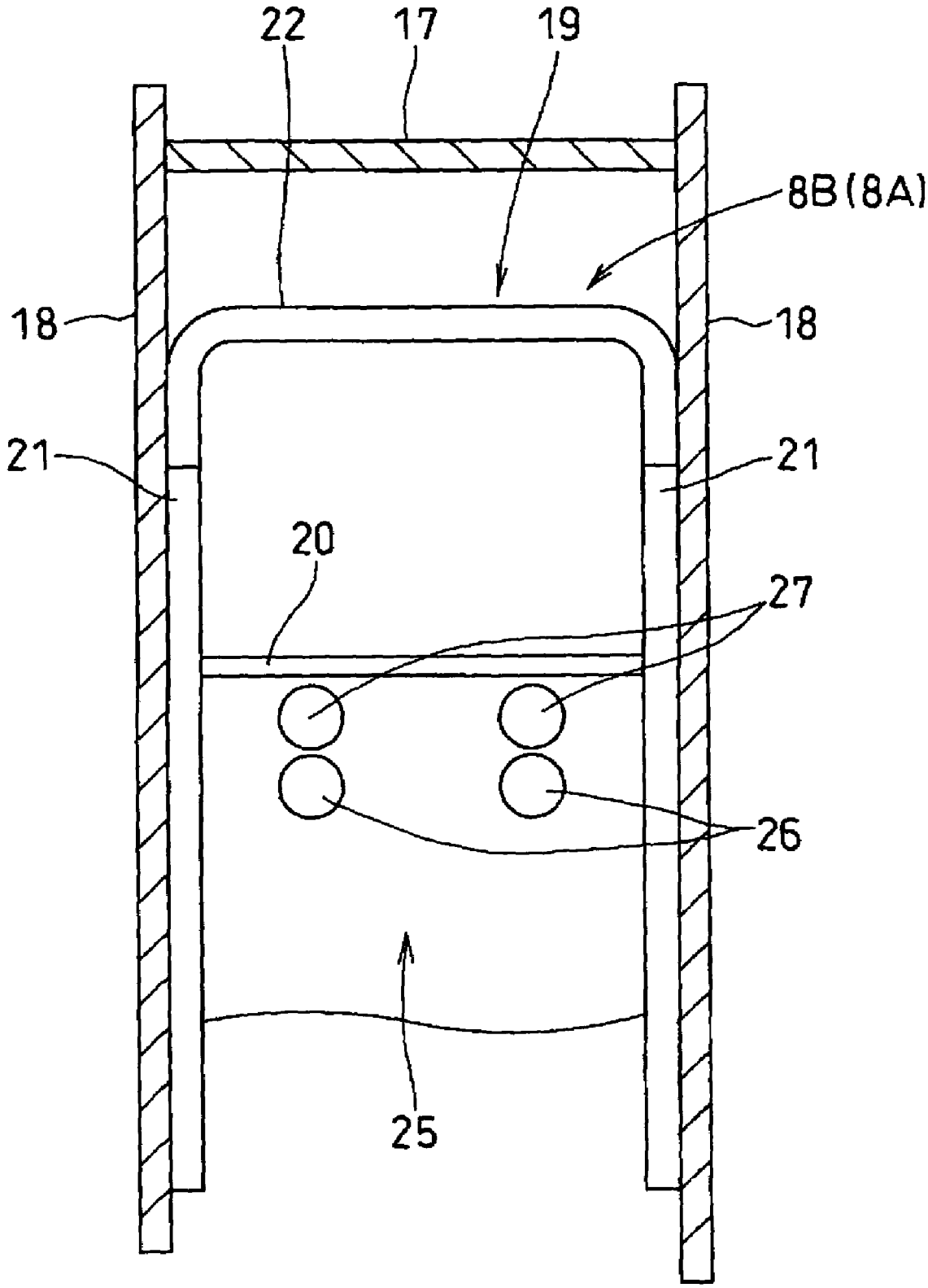
FIG. 5 is a section taken along a line V-V in FIG. 3.
Figure 6:
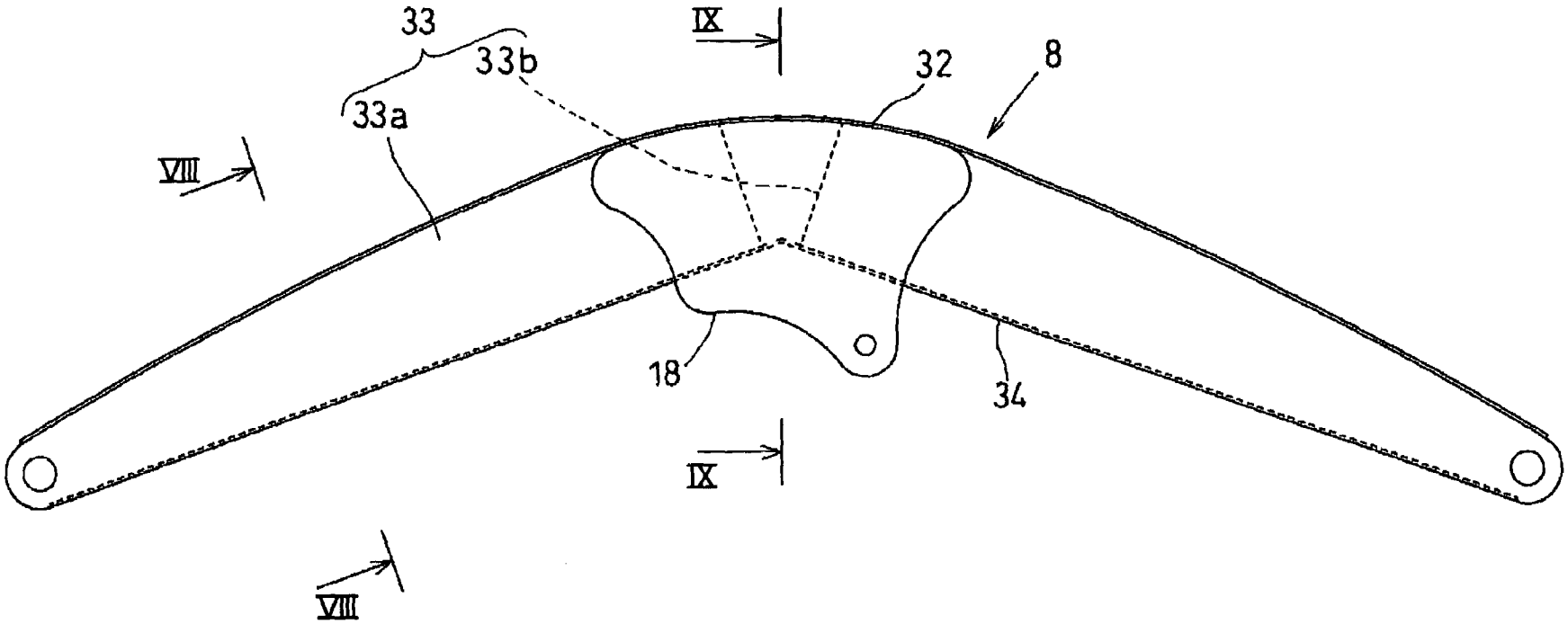
FIG. 6 is a side view showing a boom assembly according to a second embodiment of the invention.
Figure 7:
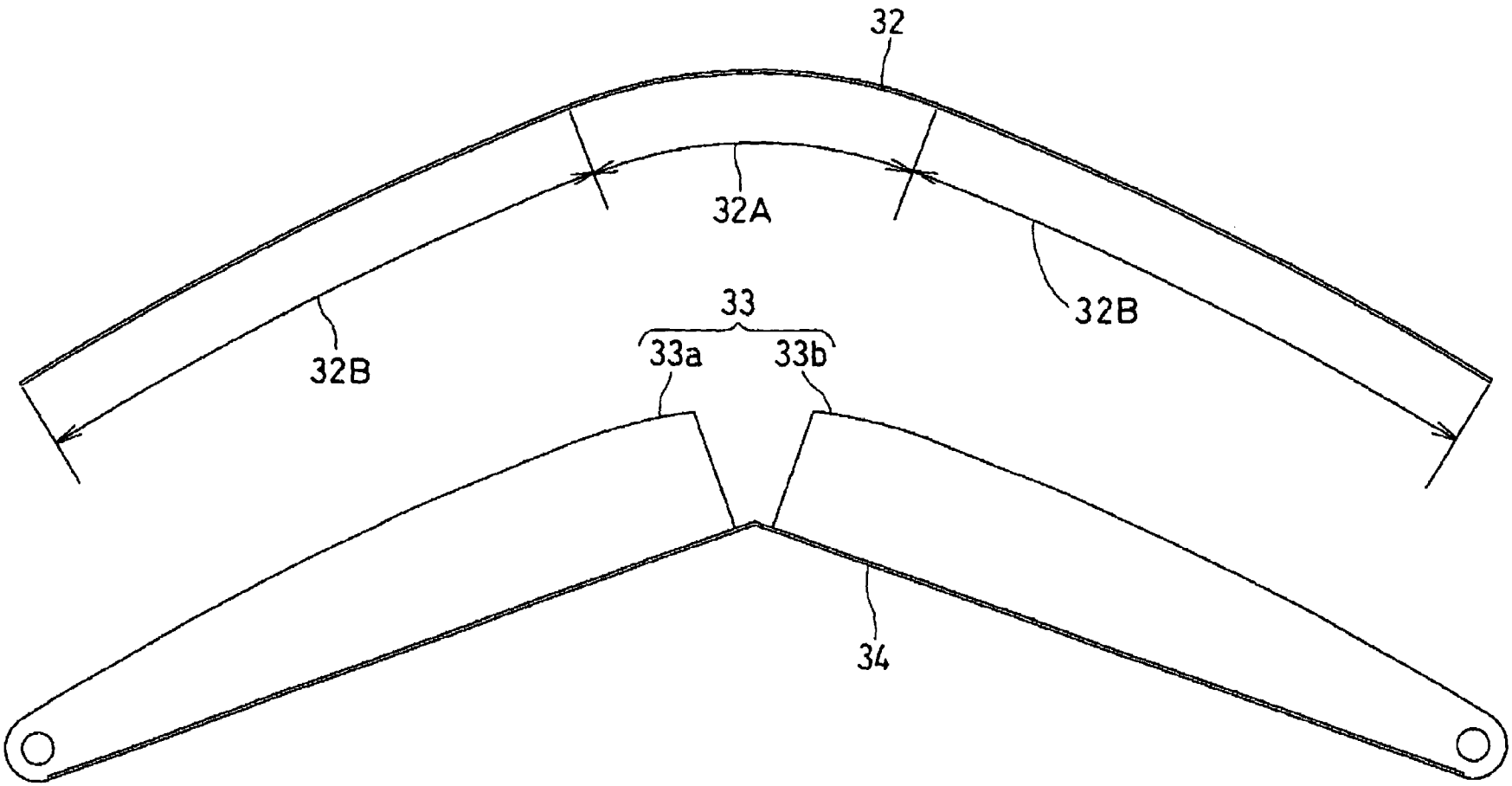
FIG. 7 is an exploded view of the boom assembly of the second embodiment.
Figure 8:
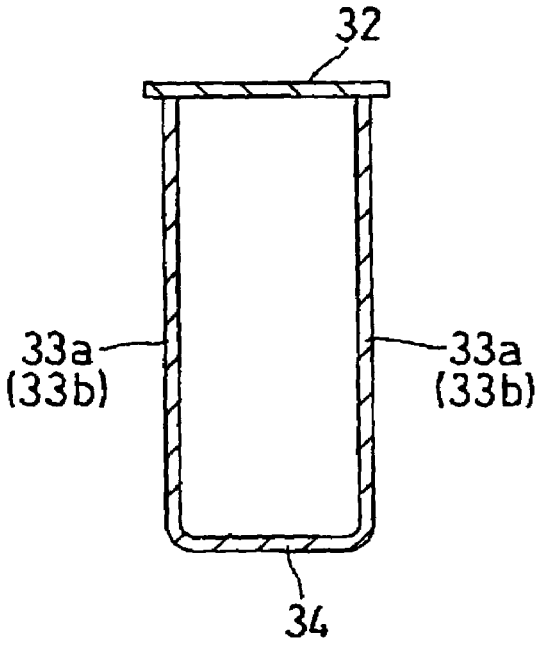
FIG. 8 is a section taken along a line VII-VII in FIG. 6.
Figure 9:
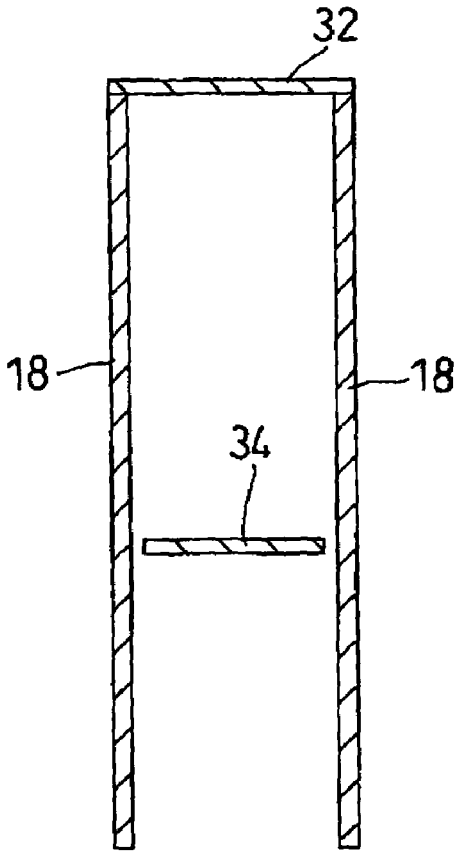
FIG. 9 is a section taken along a line IX-IX in FIG. 6.

As shown in plan view of FIG. 4, there are provided a pair of right and left booms 8 on right and left sides of the hood 6, with the right and left booms 8 being connected together at front portions thereof via a cylindrical connecting member 14.

Each of the right and left booms 8 is pivotally connected via a pin to an upper portion of the corresponding side frame 13 to be pivotable about a right/left axis, so that the booms 8 can be pivoted vertically.

Further, from a longitudinal center portion of each right/left boom 8 through a vertical intermediate portion of each right/left side frame 13, there is incorporated a boom cylinder 15 comprised of a double-acting hydraulic cylinder. In association with expansion/contraction of these right and left boom cylinders 15, the respective booms 8 can be pivoted vertically.

At a lower portion of a rear face of the bucket 9, the leading end (front end) of each right/left boom 8 is pivotally connected; and between a right/left center portion of the rear face of the bucket 9 and a right/left center portion of the connecting member 14, there is incorporated a single bucket cylinder 16 comprised of a double-acting hydraulic cylinder. Then, in association with expansion/contraction of this bucket cylinder 16, the bucket 9 can be pivoted (for scooping or dumping action).

The right/left boom 8, as shown in FIG. 2 and FIGS. 3-5, is bent at a longitudinal center portion thereof to present an upwardly convex arc shape and the vertical width of the boom progressively increases from the front or rear end toward the longitudinal center portion.

Further, this boom 8 includes, as principal components thereof, a front boom body 8A provided on the front side relative to the longitudinal center portion, a rear boom body 8B provided on the rear side relative to the longitudinal center portion, a center connecting plate 17 interconnecting the front and rear boom bodies 8A, 8B at the longitudinal center portion of the boom 8, and a pair of side plates 18 disposed on the right and left sides at the longitudinal center portion of the boom 8.

Each of the front and rear boom bodies 8A,8B consists of a main body 19 and a bottom plate 20. Further, the front and rear boom bodies 8A, 8B have an identical shape to each other so as to be formed of same components.

The main body 19 consists essentially of a pair of right and left lateral plates 21 and a top plate 22 interconnecting upper edges of the respective lateral plates 21, the main body having a downwardly open reverse U-shape cross section.

More particularly, the main body 19 of the front/rear boom body 8A, 8B is formed by bending a single plate member into the reverse U-shaped cross section and after being bent into this reverse U-shaped cross section, the plate is bent into an upwardly convex curved shape.

Further, an upper face (the upper face of the top plate 22) and a lower edge (lower edge 21 of the right/left lateral plate 21) of the main body 19 of the front/rear boom body 8A, 8B are bent into an arc face having a predetermined radius of curvature.

With the above, the upper face of the boom 8 is formed as a curved face from its front end to its rear end so as to aesthetically match the curved shape of the hood 6.

Further, at the front end of the front boom body 8A, there is provided a front pivot portion 23 comprised of a cylindrical member extending between and through the right and left lateral plates 21 and fixedly welded to these lateral plates 21. Then, to this front pivot portion 23, the bucket 9 is pivotally connected via a pin so as to be pivotable about the right/left axis.

Similarly, at the rear end of the rear boom body 8B, there is provided a rear pivot portion 24 comprised of a cylindrical member extending between and through the right and left lateral plates 21 and fixedly welded to these lateral plates 21. Then, to this rear pivot portion 24, the side frames 13 are pivotally connected via pins so as to be pivotable about the right/left axis.

Further, the rear portions of the lateral plates 21 on the right/left inner sides of the right and left front boom bodies 8A are connected together via the connecting member 14.

The bottom plate 20 is comprised of a flat plate and is disposed downwardly of the top plate 22 and between the right and left lateral plates 21 so as to extend from portions of the front and rear boom bodies 8A, 8B at the ends thereof adjacent the longitudinal center portion of the boom 8 to the front and rear pivot portions 23, 24. After the main body 19 is bent as described above, right and left lateral edges of the bottom plate 20 are fixedly welded to the inner faces of the right and left lateral plates 21.

Further, one front/rear end of this bottom plate 20 is placed in abutment against the front and rear pivot portions 23, 24 and the other front/rear end of the plate 20 is disposed at a vertical width intermediate portion at the longitudinal center portion of the boom 8 (the vertical intermediate portions of the lateral plates 21 adjacent the edges of the longitudinal center portion of the boom 8). The bottom plate 20 is disposed closest, at its longitudinal intermediate portion, to the lower edges of the lateral plates 21, and a distance from the bottom plate 20 to the lower edges 21*a* of the lateral plates 21 progressively increases from the bottom plate 20 toward the longitudinal center portion of the boom 8. With this, at the longitudinal center portion of the boom 8 and downwardly of the bottom plate 20 and between the right and left lateral plates 21, there is formed a pipe accommodating space 25.

And, within the pipe accommodating space 25 of one right/left boom 8 (the right boom in this embodiment), hydraulic pipes 26, 27 are accommodated.

The total of four hydraulic pipes 26, 27 are provided, i.e. two for the boom cylinders 15 and the other two for the bucket cylinder 16, with these pipes being arranged along the bottom plate 20.

Rear portions of the respective hydraulic pipes 26, 27 are connected via hydraulic hoses to a control valve mounted on the right main frame 12, etc.

The front portions of the hydraulic pipes 26 for the boom cylinders 15 are arranged under the connecting member 14 and on the left side along this connecting member 14 and then are connected via the hydraulic hose to the left boom cylinder 15. Also, at its right front portion, the hydraulic pipe 26 is branched by a branching member 28 which member 28 is connected via a hydraulic hose to the right boom cylinder 15.

The hydraulic pipes 27 for the bucket cylinder 16 are arranged under the connecting member 14 and on the left side along this connecting member 14. And, the pipes 27 are connected via hydraulic hoses at a right/left center portion of the connecting member 14 to the bucket cylinder 16.

As described above, because of the large distance from the bottom plate 20 to the lower edges 21*a* of the lateral plates 21 at the right/left center of the boom 8 and also the narrow width between the right and left lateral plates 21, when the bottom plate 20 is to be welded to the lateral plates 21, it may be difficult to bring welding torch between the lateral plates 21 at the longitudinal center of the boom 8 in order to weld the bottom plate 20 to the lateral plates 21 at the longitudinal center portion of the boom 8.

Therefore, the front and rear boom bodies 8A, 8B each defines a cutaway portion 29 at the upper portion of the longitudinal center portion of the boom 8. Then, from each front/rear end of the boom 8 through the longitudinal center portion of the boom 8, the bottom plate 20 is welded to the lateral plates 21 from the under side, whereas at the longitudinal center portion of the boom 8, the bottom plate 20 is welded to the lateral plates 21 from the upper side (see welding bead D in FIG. 2).

The cutaway portion 29 is formed by cutting away a predetermined longitudinal portion of the top plate 22 from an end thereof adjacent the longitudinal center portion of the boom 8, and by cutting away also portions of the right and left lateral plates 21 from the cutaway portion of the top plate to vertical width intermediate portions of the lateral plates 21.

For interconnecting the front and rear boom bodies 8A, 8B, first the bottom plates 20 are fixedly welded to the respective main bodies 19 and these are then placed in abutment against each other and then the center connecting plate 17 and the right and left side plates 18 are welded to the boom bodies 8A, 8B.

The center connecting plate 17 is formed by bending a flat plate into an upwardly convex curved shape and this plate 17 is disposed between and across the top plates 22 of the front and rear boom bodies 8A, 8B.

The radius of curvature of this center connecting plate 17 is set smaller than the radius of curvature of the upper faces of the front and rear boom bodies 8A, 8B.

Therefore, when it is desired to form the boom 8 having such different radii of curvature in its upper face at the longitudinal center portion and the front and rear sides, such boom 8 can be manufactured easily by the above-described interconnection of the members having different radii of curvature from each other.

The right and left side plates 18 are provided at the longitudinal center portion of the boom 8 along and between the lateral plates 21 of the front and rear boom bodies 8A, 8B. At a lower portion of each right/left side plate 18, there is provided a cylinder pivot portion 30 projecting downwardly from the boom 8. And, to this cylinder pivot portion 30, the boom cylinder 15 is pivotally connected.

In the mean time, the right/left inner side plate 18 extends more forwardly than the outer side plate 18 and defines a hole for allowing insertion of the connecting member 14.

Second Embodiment

Referring to FIGS. 6-9, in the case of a boom 8 relating to this further embodiment, a top plate 32 is formed separately from lateral plates 33. The top plate 32 is formed by bending a single plate member into an upwardly convex curved shape. The bending of this top plate 32 is done such that a radius of curvature thereof at a boom longitudinal center portion 32A is different from a radius of curvature thereof at boom longitudinal front and rear portions 32B.

Further, a bottom plate 34 is formed by bending a single flat plate at a longitudinal center portion thereof into an upwardly convex V-shape.

The lateral plates 33 are formed integral with the boom plate 34 by the bending of the plate member and each right/left lateral plate 33 is divided into front and rear components 33*a*, 33*b*.

In the case of this boom 8, the bending work can be a simple brake bending of the top plate 32 on a simple bending machine, so that the boom 8 having the curved upper face can be manufactured easily.

The invention claimed is:

1. A boom assembly which is bent at a longitudinal center portion thereof to present an upwardly convex shape, the assembly comprising:

a front boom body including:

a main body consisting essentially of a pair of right and left lateral plates and a top plate interconnecting upper edges of the respective lateral plates, the main body being formed with an upper face and a lower edge thereof being bent in a longitudinal direction thereof into an arc face having a predetermined radius of curvature, and a bottom plate disposed downwardly of the top plate and between the right and left lateral plates;

a rear boom body including:

a main body consisting essentially of a pair of right and left lateral plates and a top plate interconnecting upper edges of the respective lateral plates, the main body being formed with an upper face and a lower edge thereof being bent in a longitudinal direction thereof into an arc face having a predetermined radius of curvature, and a bottom plate disposed downwardly of the top plate and between the right and left lateral plates;

wherein each main body is formed by bending a plate member into a reverse U-shaped cross section;

each bottom plate is comprised of a plate member provided separately from said plate member forming the main body; and wherein a vertical distance between each bottom plate and a lower edge of each of its lateral plates form a pipe accommodating space at the longitudinal center portion of the boom assembly, downwardly of the bottom plate and between each of the left and right lateral plates, wherein the vertical distance is smallest at a longitudinal intermediate portion between each longitudinal end of the boom assembly and said longitudinal center portion, and the vertical distance progressively increases from each longitudinal intermediate portion toward the longitudinal center portion to form the pipe accommodating at said longitudinal center portion.

2. The boom assembly according to claim 1, wherein said front and rear boom bodies have an identical shape to each other.

3. The boom assembly according to claim 1, wherein said each boom body includes a cutaway portion which is formed by cutting away a predetermined longitudinal portion of the top plate from an end thereof adjacent the longitudinal center portion of the boom assembly, and by cutting away portions of the right and left lateral plates from the cutaway portion of the top plate along a vertical direction of the right and left lateral plates.

4. The boom assembly according to claim 1, wherein the radius of curvature of the upper face of the boom assembly at the longitudinal center portion is different from that at the front and rear longitudinal ends, and at the longitudinal center portion, there is provided a center connecting plate for interconnecting the top plates of the two boom bodies, the center connecting plate having an upwardly convex curved shape.

5. A boom apparatus comprising:

a pair of right and left boom assemblies, each said boom assembly including a front boom body and a rear boom body welded to the front boom body to present an upwardly convex shape, each of the boom bodies including a main body comprising a pair of right and left lateral plates and a top plate interconnecting upper edges of the respective lateral plates, the main body being formed with an upper face and a lower edge thereof being bent in a longitudinal direction thereof into an arc face having a predetermined radius of curvature, and a bottom plate disposed downwardly of the top plate and between the right and left lateral plates, each said main body being formed by bending a plate member into a reverse U-shaped cross section, each bottom plate being comprised of a plate member provided separately from said plate member forming the main body; and a connecting member for interconnecting the front boom body of the right boom assembly and the front boom body of the left boom assembly, wherein each said boom assembly has a vertical distance between the bottom plate and a lower edge of each lateral plate progressively increasing from the portion below the connecting member toward the longitudinal center portion; and a pipe accommodating space is formed in each said boom assembly downwardly of the bottom plate and between the right and left lateral plates, said pipe accommodating space extending from a portion below the connecting member through to a longitudinal center portion of each said boom assembly.

6. The boom apparatus according to claim 5, wherein said front and rear boom bodies have an identical shape to each other.

7. The boom apparatus according to claim 5, wherein each said boom body includes a cutaway portion which is formed by cutting away a predetermined longitudinal portion of the top plate from an end thereof adjacent the longitudinal center portion of the boom assembly, and by cutting away portions of the right and left lateral plates from the cutaway portion of the top plate along a vertical direction of the right and left lateral plates.

8. The boom apparatus according to claim 5, wherein the radius of curvature of the upper face of each said boom assembly at the longitudinal center portion is different from that at the front and rear longitudinal ends, and at the longitudinal center portion, there is provided a center connecting plate for interconnecting the top plates of the two boom bodies, the center connecting plate having an upwardly convex curved shape.

* * * * *